United States Patent [19]

Peterson

[11] 4,100,832

[45] Jul. 18, 1978

[54] TREMOLO FOR A STRING INSTRUMENT

[76] Inventor: James R. Peterson, Rte. 1, Box 664, Wilton, Calif. 95693

[21] Appl. No.: 708,427

[22] Filed: Jul. 26, 1976

[51] Int. Cl.[2] ..... G10D 3/12

[52] U.S. Cl. ..... 84/313

[58] Field of Search ..... 84/313

[56] References Cited

U.S. PATENT DOCUMENTS

| | | | |
|---|---|---|---|
| 2,136,627 | 11/1938 | Lohman | 84/313 |
| 2,241,911 | 5/1941 | Kauffman | 84/313 |
| 3,252,368 | 5/1966 | Jeffery et al. | 84/313 |

*Primary Examiner*—Lawrence R. Franklin
*Attorney, Agent, or Firm*—Watson, Cole, Grindle & Watson

[57] ABSTRACT

A string instrument having a tremolo which causes a rapid reiteration of the musical tone generated by the vibrating strings of the instrument so as to produce a tremulous effect. While the strings are vibrated in a direction transverse to their longitudinal axis for producing the basic musical tone, the tremulous effect is provided by adding a slow vibration to the strings along their longitudinal axis. For this purpose, a movable elongated member is coupled to the strings at one of their ends. This elongated member can be subjected to an appropriate movement for causing the desired tremulous effect within the strings. A drive mechanism automatically moves the elongated member at a selected frequency so as to vary the tension within the strings and render the tremulous effect.

8 Claims, 4 Drawing Figures

TREMOLO FOR A STRING INSTRUMENT

BACKGROUND OF THE INVENTION

The present invention relates to the provision of a tremolo on a string instrument for varying the tension within the strings so as to render a tremulous effect.

By varying the tension within the strings of a string instrument along the longitudinal axis of the strings, a tremulous effect can be produced as the strings are vibrated. Such an effect causes a rapid reiteration of the musical tones so as to sustain the tone produced by the vibrating strings.

Tremolos for producing such an effect within a string instrument have been well known for many years. The typical tremolo, however, has been hand operated. Such devices have required the player of the string instrument to utilize one hand for moving a hand lever. As the lever is rotated about an axis, it increases and decreases the tension within the strings along their longitudinal axis.

The operation of such a hand operated tremolo has been found to greatly limit the playing ability of the user. The utilization of such a tremolo significantly increases the complexity and required coordination in playing the instrument. When a number is being played which is in the least bit complicated it is generally required that the user release the tremolo lever completely since both hands must be free for playing the instrument.

With the advent of the electric guitars, the problems involved in utilizing a hand operated lever tremolo have been resolved by an appropriate electronic mechanism. Such a mechanism electronically generates the equivalent of a tremolo effect. With the utilization of such an electronic mechanism, however, it is difficult to obtain a slow varying effect which can be sustained over a prolonged period. The electronic mechanisms are either switched on or off and hence have sharply defined periods of operation. When the electronic tremolo cuts off the volume, it causes a loss of some of the tone and the desired sustentation of the tone which is obtained with a hand operated tremolo.

Typical hand operated lever tremolos are illustrated in the following U.S. Patents: U.S. Pat. No. 2,972,923 issued to C. L. Fender; U.S. Pat. No. 3,252,368 issued to A. W. Jeffery et al.; and U.S. Pat. No. 3,437,001 issued to A. A. Kraft. All of these tremolos require the player to hand operate the lever for rendering the desired tremulous effect.

Examples of the electronic type tremolos are illustrated in U.S. Pat. Nos. 3,742,114 issued to R. G. Barkan and 3,136,853 issued to A. J. Bissonette et al. These electronic tremolos, however, suffer from those types of drawbacks previously discussed above.

Other types of vibration devices have been utilized with musical instruments, such as illustrated in U.S. Pat. Nos. 1,407,434 issued to B. E. Mills and 3,267,790 issued to C. R. de John et al. The devices illustrated by these patents, however, cannot be easily and readily utilized for a tremolo device for a string instrument as desired in accordance with the present invention. The patent to Mills provides an electromagnetic tremolo which is designed to be utilized in a self-playing violin. The type of electromagnetic device illustrated in this patent would cause several problems if an attempt was made to utilize it on a modern string instrument since the device is extremely heavy and massive and would additionally cause electric static in the electric pickups and amplifiers typically utilized today with string instruments. In the patent to de John et al, a device for directly vibrating an instrument is illustrated. While this type of device could be utilized for directly vibrating the strings of the string instrument, it cannot be utilized in rendering a tremolo effect such as desired in accordance with the present invention.

SUMMARY OF THE PRESENT INVENTION

An object of the present invention is to provide a tremolo which overcomes the drawbacks of previously known tremolos as discussed above.

Another object of the present invention is to provide an automatically controlled tremolo which while not having to be hand operated still renders a tremulous effect similar to a hand operated tremolo.

A further object of the present invention is to provide a tremolo for a string instrument which automatically varies the tension within the string at a variable selected frequency for rendering a tremulous effect.

These objectives are achieved in the utilization of the tremolo of the present invention. The operation of this tremolo is premised upon the automatic movement of an elongated member which is attached to one end of the strings so as to vary the tension in the strings as the member is moved back and forth between two positions. Each of the strings at one end are connected to the elongated member which extends along a longitudinal axis transverse to the strings. The elongated member is mounted so as to be capable of being rotated between a first and second position. As it is rotated back and forth between these two positions, the elongated member increases and decreases the tension within the strings. A tremolo lever is coupled to the elongated member and is utilized in providing the rotational movement to the elongated member. By applying a slight force to the end of the tremolo lever opposite the end connected to the elongated member it is possible to provide the desired rotational movement within the elongated member. Since the force is applied at a distance from the rotational axis, which is the same as the longitudinal axis, of the elongated member, the leverage which is obtained makes is possible to utilize only a slight force in order to vary the tension within the strings. By moving the tremolo lever up and down along a translational axis, the desired rotational movement of the elongated member between the rotational positions is provided.

In the actual embodiments of the tremolo device, a force is applied in a first direction to the tremolo lever at the end opposite the end connected to the elongated member for moving the elongated member from a first to a second position. A return spring is coupled to the elongated member for applying an appropriate force returning the member to its first, or original, position. Thus, the force applied on the tremolo lever acts against the force of the spring so as to move the elongated member into a second position and subsequently allows the force of the spring to move the elongated member back into its first position.

The force applied to the tremolo lever is generated through the utilization of an electric motor which is driven at a variable, selected frequency, which can be varied if so desired. The output shaft of the electric motor is coupled to the end of the tremolo lever where the force is to be applied. The coupling mechanism can be either in the form of a gear drive mechanism or an eccentric cam so as to provide the desired movement of the tremolo lever for rendering the rotational movement of the elongated member.

DESCRIPTION OF THE PREFERRED EMBODIMENTS

Figure 1:
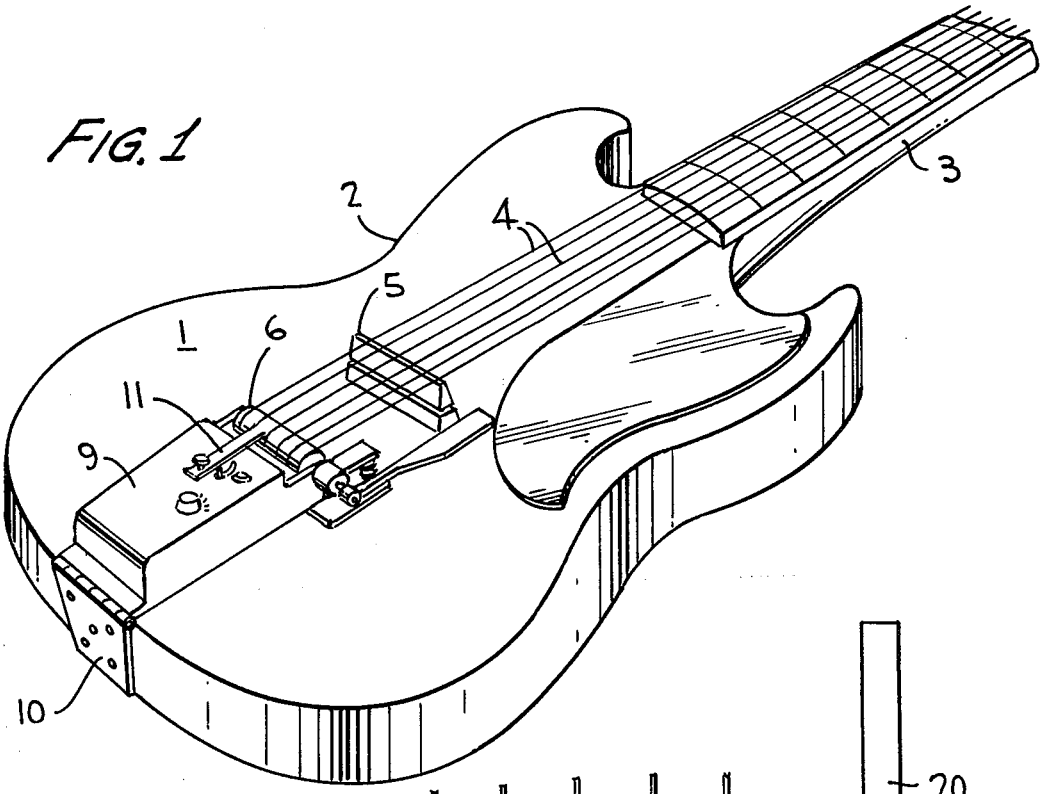
FIG. 1 is a perspective view of a portion of a string instrument having mounted thereon a tremolo in accordance with the present invention.

A guitar 1 has a hollow body portion 2 and an extended neck 3, as illustrated in FIG. 1. A plurality of strings 4 extends along the guitar from a lever 6, to which each of the strings are attached, to the far end of neck portion 3. A bridge 5 supports the strings near lever 6.

Figure 2:
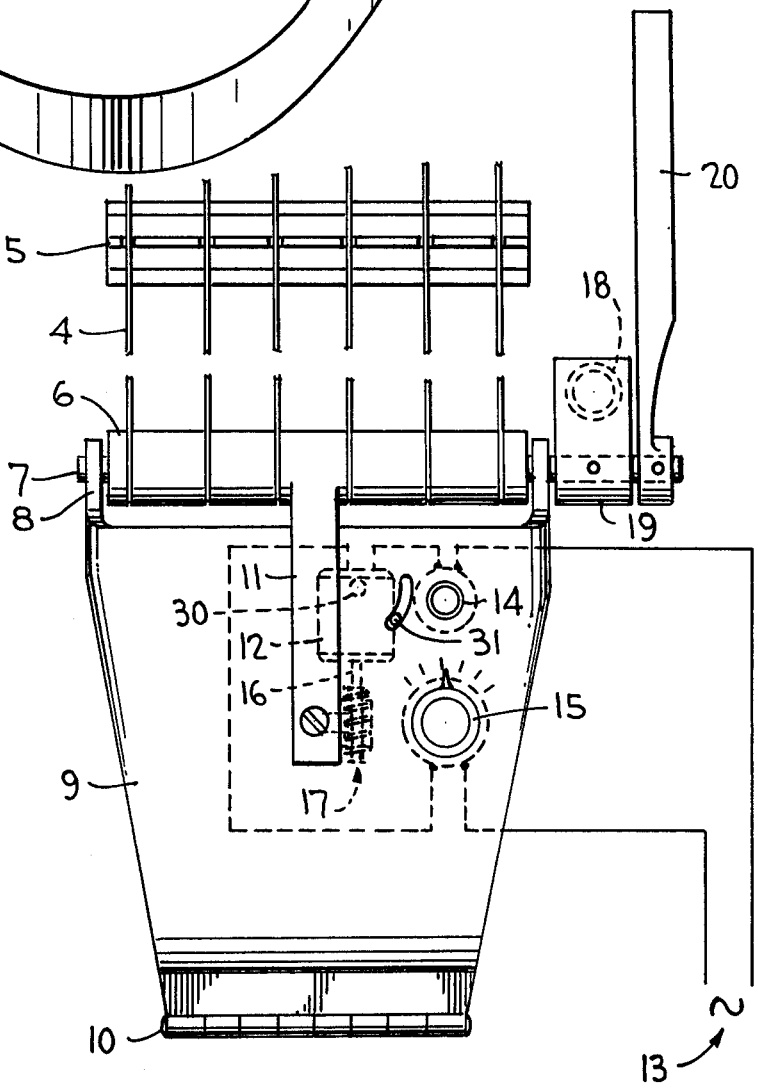
FIG. 2 is a plan view of the tremolo mounted on the string instrument of FIG. 1 with a portion of the instrument also being illustrated.
Figure 3:
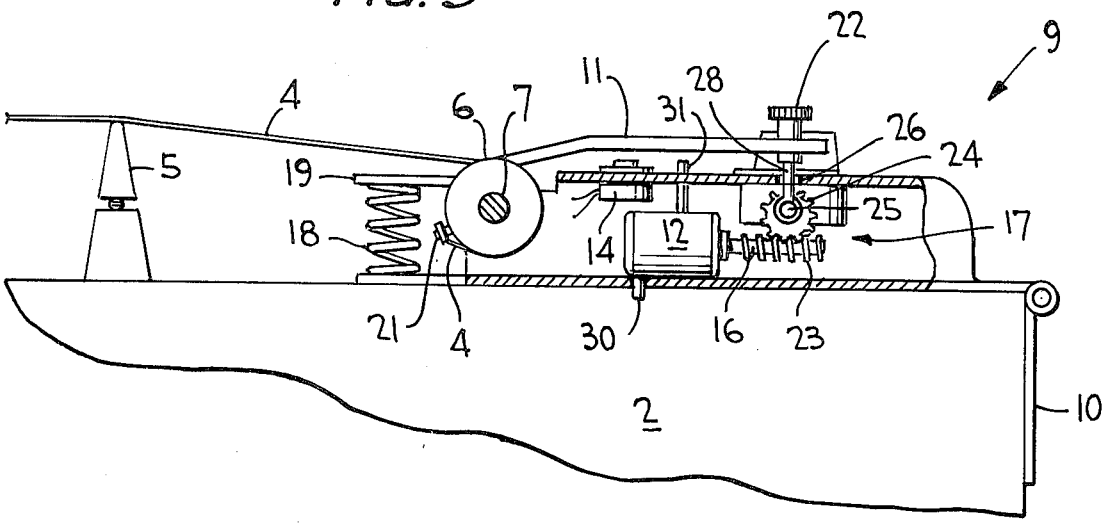
FIG. 3 is a side elevational view of the string instrument and tremolo illustrated in FIG. 1, with a portion of the housing for the tremolo being broken away.
Figure 4:
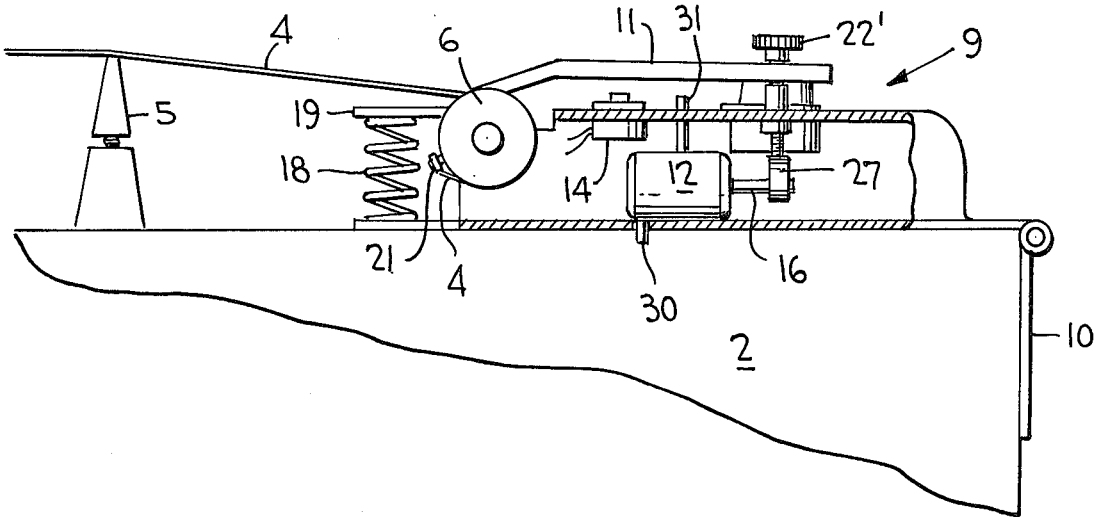
FIG. 4 is a view similar to FIG. 3 of another embodiment of the tremolo of the present invention.

Strings 4 are wrapped around lever 6 with each string being connected to a pin 21 mounted on the lower portion of the lever (as illustrated in FIGS. 3 and 4). Lever 6 is mounted on bearing shaft 7, which in turn is mounted so as to be capable of being rotated within bearing mountings 8 as illustrated in FIG. 2. Lever 6 is thus movable in a direction transverse to its longitudinal axis. By rotating lever 6 between first and second rotational positions the tension within strings 4 can be varied.

An automatic tremolo control and drive mechanism 9 is coupled to lever 6 through a tremolo lever 11. Tremolo mechanism 9 is secured to the guitar by a clamp 10. This tremolo mechanism provides an appropriate low frequency force to tremolo lever 11 which in turn causes lever 6 to be rotated between its first and second rotational positions thereby varying the tension within strings 4. As strings 4 are vibrated by the playing of guitar, the variation in the tension of the strings will induce a tremulous effect so as to sustain the notes and chords being played.

Tremolo mechanism 9 includes an electric motor 12 which provides a rotational drive to its output shaft 16, as shown in FIG. 2. The rotational movement of shaft 16 is coupled through an appropriate coupling mechanism, such as screw drive mechanism 17, to tremolo lever 11 so as to provide an appropriate movement to the tremolo lever. The end of tremolo lever 11 coupled to the output shaft 16 moves in a direction approximately perpendicular to the planar surface of guitar 1. As lever 11 is so moved it applies an appropriate rotational force to lever 6. Due to the leverage involved only a relatively small force needs to be applied to the end of tremolo lever 11 so as to create the desired force for rotating lever 6. The movement of lever 6 is also controlled with the utilization of a return spring 18 which is coupled to the lever through a flange 19. Spring 18 helps to dampen and limit the rotational movement of lever 6 and also biases the lever into its first rotational position.

Thus the primary purpose of the tremolo lever is to move lever 6 from this first rotational position in which it is normally biased into its second rotational position. In the first rotational position the strings are stretched to their maximum tension, while in the second position the tension on the strings is relaxed.

Electric motor 12 is applied with power from a power source 13, which provides either an AC or DC signal. Additionally, an on/off switch 14 and a speed control rheostat 15 can be provided. Rheostat 15 enables the output speed of electric motor 12 to be varied, with the typical variation being between one and five cps.

A first embodiment of the tremolo mechanism 9 is illustrated in FIG. 3. As shown, output shaft 16 of electric motor 12 is coupled to tremolo lever 11 through a gear coupling mechanism 17, shaft 28 and screw 22. Gear coupling mechanism 17 includes a worm gear 23 mounted on output shaft 16 and a gear 24 positioned so as to be rotated by worm gear 23. A shaft 28 is connected to gear 24 by a pivot bearing 25. Pivot bearing 25 is located at a position spaced from the center of gear 24. Thus as gear 24 is rotated shaft 28 will be moved up and down in a direction approximately perpendicular to the planar surface of the guitar. Shaft 28 extends through an opening 26 in the housing of tremolo mechanism 9. The exposed end of shaft 28 contacts a lower end of adjustment screw 22. Screw 22 in turn is coupled to the end of tremolo lever 11 so as to impart a similar perpendicular type movement to this end of the tremolo lever.

As gear 24 is rotated so that shaft 28 extends into its extreme outer position, the corresponding end of tremolo 11 is likewise moved in an upward extending direction. This movement of tremolo lever 11 in turn rotates lever 6 in a direction transverse to its longitudinal axis so that lever 6 is moved into its second rotational position. In this second rotational position the tension on strings 4 is relaxed. As the rotation of gear 24 continues, shaft 28 is withdrawn to its lower position. At this point, the action of spring 18 causes lever 6 to be rotated back to its initial position in which the tension on strings 4 is increased. As lever 6 returns to its initial position, lever 11 is likewise rotated so that the end portion is lowered. The movement of this end of tremolo lever 11, however, is limited by its contact with shaft 28. By adjusting the position of screw 22, the length of shaft 28 is effectively varied and hence the maximum extent of movement of shaft 11 is also varied.

In the embodiment illustrated in FIG. 4, the gear coupling mechanism 17 is replaced by the utilization of an eccentric cam 27. Eccentric cam 27 is mounted on output shaft 16 so as to be rotated by the shaft. Cam 27 is positioned in contact with the lower end of adjustment screw 22'. As cam 27 rotates adjustment screw 22' moves up and down in a direction perpendicular to the planar surface of the guitar and likewise imparts a similar movement to the corresponding end of tremolo lever 11. As with the embodiment illustrated in FIG. 3, the movement of the end of tremolo lever 11 imparts a rotational movement to lever 6. As before, this rotational movement of lever 6 causes the tension within strings 4 to vary.

Consequently, the tremolo mechanism 9 causes a tremulous effect to be automatically created within strings 4 without requiring any action on the part of the player outside of turning on the system and setting the desired speed. While the tremulous effect is automatically created, the effect is identical to that produced with a hand operated tremolo and does not exhibit those drawbacks of the mechanisms which electronically simulate the tremulous effects.

If the tremolo is maintained in contact with lever 11 when not in use, it can cause the instrument to be out of tune unless lever 11 is allowed to return to a neutral position in which the tension in the strings is maintained at a normal in tune level. In order to maintain the tuning of the instrument, when the automatic tremolo is not being utilized, it is possible to disengage the tremolo device from engagement with lever 11. For this purpose, motor 12 can be mounted on a pin 30 and is provided with a lever 31. By pressing lever 31, motor 12 can be swiveled about pin 30 and out of engagement with lever 11.

If so desired, it is also possible to utilize a hand lever with the present invention so as to enable the tremolo to also be hand operated. For this purpose, a hand lever 20 can be provided as illustrated in FIG. 2. Movement of lever 20 will in turn cause lever 6 to be rotated between its two positions for varying the tension within strings 4.

It is noted that the above description and the accompanying drawings are provided merely to present exemplary embodiments of the present invention and that additional modifications of such embodiments are possible within the scope of this invention without deviating from the spirit thereof.

I claim:

1. A tremolo for a string instrument having a plurality of strings stretched across a body, the tremolo comprising:

a movable elongated member coupled to the strings at one of their ends and having its longitudinal axis extending along an axis transverse to the strings and said elongated member being rotatable about its longitudinal axis so as to be movable in a direction transverse to its longitudinal axis; and, drive means for automatically moving said movable member in a direction transverse to its longitudinal axis at a selected frequency so as to vary the tension within the strings and render a tremulous effect, said drive means including an electrical drive motor having a rotatable output shaft and coupling means coupled between said output shaft and said elongated member for transferring the rotational movement of said shaft into a movement of said elongated member at the selected frequency, and said coupling means including a coupling lever coupled to said elongated member and an eccentric cam mounted on said shaft in such a position so that as it is rotated by said drive means said cam causes said coupling lever to generate a rotational movement of said elongated member about its longitudinal axis.

2. A tremolo as defined in claim 1 further comprising a spring member for biasing said elongated member into one rotational position and wherein as said eccentric cam rotates it moves said coupling lever so as to in turn cause said elongated member to be rotated into another position.

3. A tremolo as defined in claim 1 wherein said drive means further comprises means for varying the speed of said electric motor.

4. A tremolo as defined in claim 3 wherein said drive mechanism operates at a speed between 1 and 5 c.p.s.

5. A tremolo for a string instrument having a plurality of strings stretched across a body, the tremolo comprising:

a movable elongated member coupled to the strings at one of their ends and having its longitudinal axis extending along an axis transverse to the strings, and said elongated member being rotatable about its longitudinal axis so as to be movable in a direction transverse to its longitudinal axis; and, drive means for automatically moving said movable member in a direction transverse to its longitudinal axis at a selected frequency so as to vary the tension within the strings and render a tremulous effect, said drive means including an electrical drive motor having a rotatable output shaft and coupling means coupled between said output shaft and said elongated member for transferring the rotational movement of said shaft into a movement of said elongated member at the selected frequency, and said coupling means including a coupling lever coupled to said elongated member and gear drive means coupled between said shaft and said coupling lever so that in response to movement of said shaft said coupling lever causes said elongated member to move in a rotational direction about its longitudinal axis.

6. A tremolo as defined in claim 5 further comprising a spring member for biasing said elongated member into one rotational position and wherein said gear drive mechanism moves the coupling lever for causing said elongated member to be rotated into another rotational position.

7. A tremolo as defined in claim 5 wherein said drive means further comprises means for varying the speed of said electric motor.

8. A tremolo as defined in claim 7 wherein said drive means operates at a speed between 1 and 5 c.p.s.

* * * * *